United States Patent [19]

Grzesnikowski

[11] 4,313,586

[45] Feb. 2, 1982

[54] UNIVERSAL EQUIPMENT LEG

[76] Inventor: Walter Grzesnikowski, 633 Center Ave., Cornwells Heights, Pa. 19020

[21] Appl. No.: 48,683

[22] Filed: Jun. 14, 1979

[51] Int. Cl.[3] ..... F16M 11/24

[52] U.S. Cl. ..... 248/188.4

[58] Field of Search ..... 5/310; 248/188.2, 188.4; 151/15; 16/19, 42; 312/255, 256

[56] References Cited

U.S. PATENT DOCUMENTS

| | | | |
|---|---|---|---|
| 3,104,493 | 9/1963 | Nalle | 248/188.4 |
| 3,150,853 | 9/1964 | Lisbin | 248/188.4 |
| 4,108,407 | 8/1978 | Cable | 248/188.4 |

OTHER PUBLICATIONS

Catalogue No. 76, Kason Hardware Corp., Binghamton, N.Y. 13902, pp. 95, 96.

*Primary Examiner*—William H. Schultz

*Attorney, Agent, or Firm*—Weiser, Stapler & Spivak

[57] ABSTRACT

A universal equipment leg is disclosed which includes a molded leg body having a configured axial bore. The body terminates upwardly in an integral flange which is provided with a plurality of holes for direct connection when desired to the bottom of a piece of equipment. A split, threaded insert upwardly inserts into the axial bore and adjustably receives therein a threaded foot for equipment height adjustment purposes. When a threaded stud connection to the bottom of the equipment is desired, a bolt adaptor assembly downwardly inserts into the axial bore to firmly secure a mounting bolt with the threaded shank projecting upwardly from the flange. Bolts of different sizes, with suitable split bolt adaptors, can be employed with the same leg body to thereby render the device universally adaptable for use with most types of equipment, even when produced by different manufacturers.

13 Claims, 5 Drawing Figures

FIG. 1
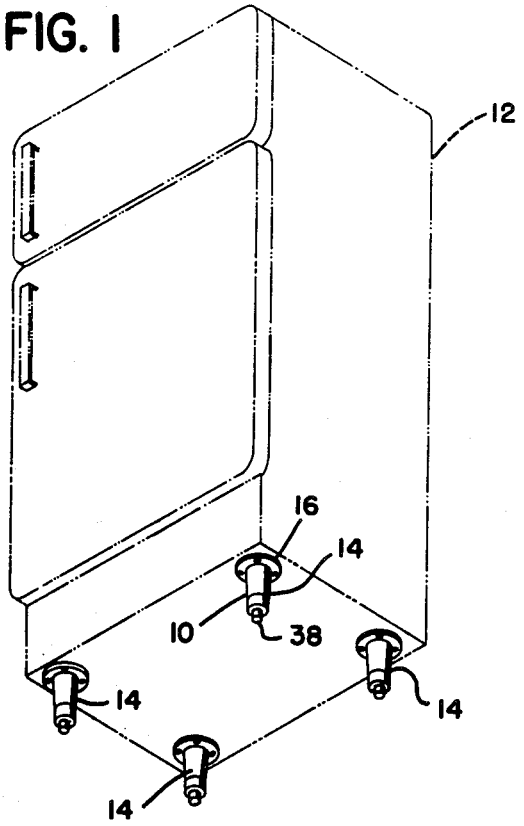
FIG. 2
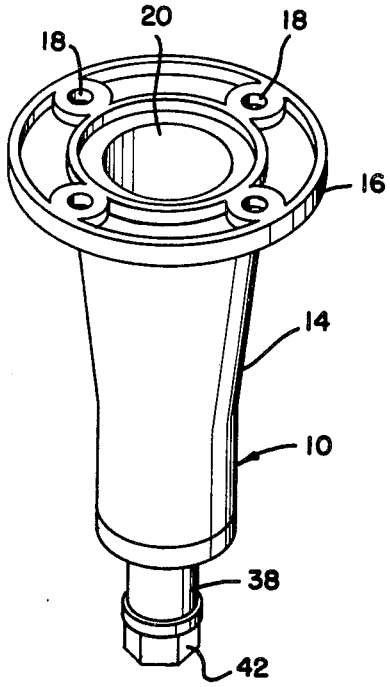
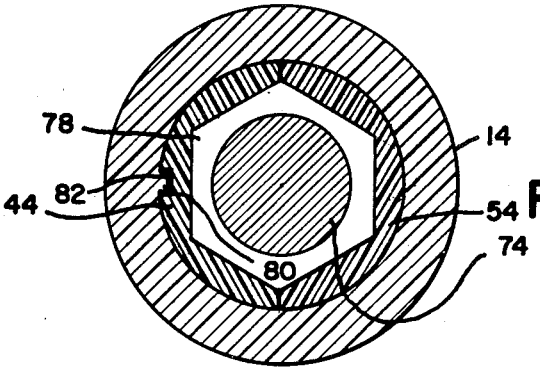
FIG. 4

UNIVERSAL EQUIPMENT LEG

BACKGROUND OF THE INVENTION

This invention relates generally to the field of adjustable supports, and more particularly, is directed to a universal equipment leg suitable for use with commercial equipment of all descriptions, such as the type suitable for kitchen use in restaurants and hospitals.

It is the common practice to provide adjustable legs for commercial food service equipment that is designed for easy height adjustment and which includes sealing systems suitable to resist vermin infestation. The prior art support legs generally have been designed to comply with applicable NSF regulations and recommendations in this regard. The adjustable equipment legs heretofore developed have generally proved satisfactory in use and each usually includes an elongated body which may be fabricated of metal or plastic and within which is mounted an adjustable foot for height adjustment purposes.

In the case of some equipment designs, the leg body is provided with an integral mounting flange having holes therethrough whereby the leg can be bolted directly to the bottom of the equipment by employing suitable fasteners such as bolts or screws. In other types of equipment, it has been necessary to fabricate an adjustable leg which includes an upper threaded stud to threadedly engage a threaded socket which is provided in the equipment. Various manufacturers and even various pieces of equipment of the same manufacturer can employ different size threaded sockets. Accordingly, prior workers in the art have found it necessary to design, manufacture and stock numerous models of adjustable legs wherein threaded studs of various diameters and pitches can be provided and wherein flange type mountings can also be made available.

Of course, as the need for different adjustable support models to meet the various requirements of the equipment manufacturers increases, costs will also increase due to the larger number of molds, parts, storage requirements and increased design, engineering and testing expenditures. At the present time, so far as is known, there is no universal support design that can make a single equipment support leg compatible for use with most commonly employed equipment constructions.

SUMMARY OF THE INVENTION

The present invention relates generally to the field of commercial food service equipment supports, and more particularly, is directed to a universal equipment leg construction wherein a single leg design can be universally adapted for use with most common equipment leg mountings.

The universal equipment leg of the present invention includes a molded or otherwise formed body of suitable length so as to permit necessary height adjustment. The body is provided with a configured axial bore which is medially divided into respective upper and lower sections. The lower section is truncated conical in configuration and flares outwardly slightly to receive therein a split, threaded foot insert in a tight press fit. The split foot inserts, when joined within the axial bore, form an internally threaded socket suitable to adjustably receive therein a threaded foot in a height adjustable threaded connection to facilitate easy equipment height variation by turning the foot relative to the seated split insert.

The adjustable leg body is upwardly provided with an integral, outwardly extending, mounting flange having usual fastener openings therethrough to permit the device to be bolted or otherwise firmly secured to the bottom of the piece of equipment by inserting conventional fasteners through openings in the mounting flange to secure the leg body to the equipment in known manner.

When the piece of equipment to which the adjustable leg is to be attached is designed with a threaded socket for attachment of the leg body, then an additional split stud adaptor assembly is provided to downwardly insert into the upper section of the body axial bore in a tight, sealed interconnection. The split stud adaptor assembly includes a pair of adaptor halves which are molded or otherwise formed with cooperating threaded halves and semi-hexagonal, cooperating sockets to receive therein the head of a threaded bolt. Accordingly, a conventional bolt of a preselected size can be secured within the split bolt adaptors and then the assembly comprising the bolt and the split adaptor halves can be downwardly inserted into the axial bore of the leg body to be secured in a press fit.

It is contemplated that a plurality of different split bolt adaptors can be readily provided for use with a single leg body design to accommodate bolts of various sizes, for example, $\frac{3}{4}$"-10 by $2\frac{1}{2}$" long, $\frac{5}{8}$"-12 by $2\frac{1}{2}$" long, $\frac{1}{2}$"-13 by 2" long, etc. Accordingly, the same leg body with integral mounting flange and the same adjustable foot can be provided for all usual pieces of equipment from various manufacturers. In this manner, only a single mold design and a single inventory of these parts need be maintained. Then the leg body, with the height adjustable foot bottomly inserted, can be rendered universally adaptable to practically any type of threaded socket by simply providing different split stud or bolt adaptors of different sizes to secure the particular size threaded bolt that may be required for a particular application.

In a preferred embodiment, the upper section of the axial bore is provided with a pair of sealing rings which tightly seal against the outer periphery of the split bolt adaptors to prevent the entrance of vermin or other undesirable or un-sanitary foreign material therein. If desired, cooperating circular recesses may be provided in the outer periphery of the split bolt adaptors to receive and lock therein the sealing rings of the axial bore in a manner to relatively permanently assemble the parts into a cooperating unit. The tight engagement of the split bolt adaptor within the upper section of the axial bore provides a solid mass in conjunction with the leg body to thereby provide an assembly of great strength suitable to hold and support extremely heavy loads of the type which may be encountered when supporting commercial refrigeration equipment and the like.

It is therefore an object of the present invention to provide an improved universal equipment leg of the type set forth.

It is another object of the present invention to provide a novel universal equipment leg of design to facilitate either flange mounting or stud mounting with minor adjustments.

It is another object of the present invention to provide a novel universal equipment leg incorporating a leg body including an axial bore, split foot insert means which are upwardly insertable into the axial bore and split stud or bolt adaptor means which are downwardly insertable into the axial bore whereby a height adjustable foot and a mounting stud of easily variable size can be readily provided.

It is another object of the present invention to provide a novel universal equipment leg including a leg body having an axial bore and various size split stud adaptors which can be secured within the bore, each pair of adaptors being capable of securing a different size mounting stud to the leg body construction.

It is another object of the present invention to provide a novel universal equipment leg including an integral flange and adjustable mounting means of suitable design to render the assembly universally adaptable for attachment to most types of commercial food service equipment.

It is another object or the present invention to provide a novel universal equipment leg comprising a body having an axial bore, the axial bore being medially divided into upper and lower sections, a split, threaded foot insert being a press fit within the lower section to threadedly receive a threaded adjustment foot therein, and a split stud or bolt adaptor assembly being a press fit within the upper section of the axial bore, a standard bolt being secured within split bolt adaptors to project upwardly from the body whereby an adjustable foot can be easily adapted to be threadedly secured to a piece of commercial food service equipment.

It is another object of the present invention to provide a novel universal equipment leg that is adjustable in nature, universally adaptable for mounting to most equipment designs and which is sealed against vermin and other unsanitary conditions to provide a substantially universally adaptable adjustable equipment leg.

It is another object of the present invention to provide a novel universal equipment leg that is simple in design, inexpensive in manufacture and trouble free when in use.

Other objects and a fuller understanding of the invention will be had by referring to the following description and claims of the preferred embodiment, taken in conjunction with the accompanying drawings, wherein like reference characters refer to similar parts throughout the several views and in which:

BRIEF DESCRIPTION OF THE DRAWINGS

FIG. 1 is a bottom perspective view of the adjustable leg in place to support a piece of equipment.

FIG. 2 is an enlarged, perspective view of the adjustable leg without the bolt adaptor assembly.

FIG. 4 is a cross sectional view taken along line 4—4 on FIG. 3, looking in the direction of the arrows.

DESCRIPTION OF THE PREFERRED EMBODIMENT

Figure 3:
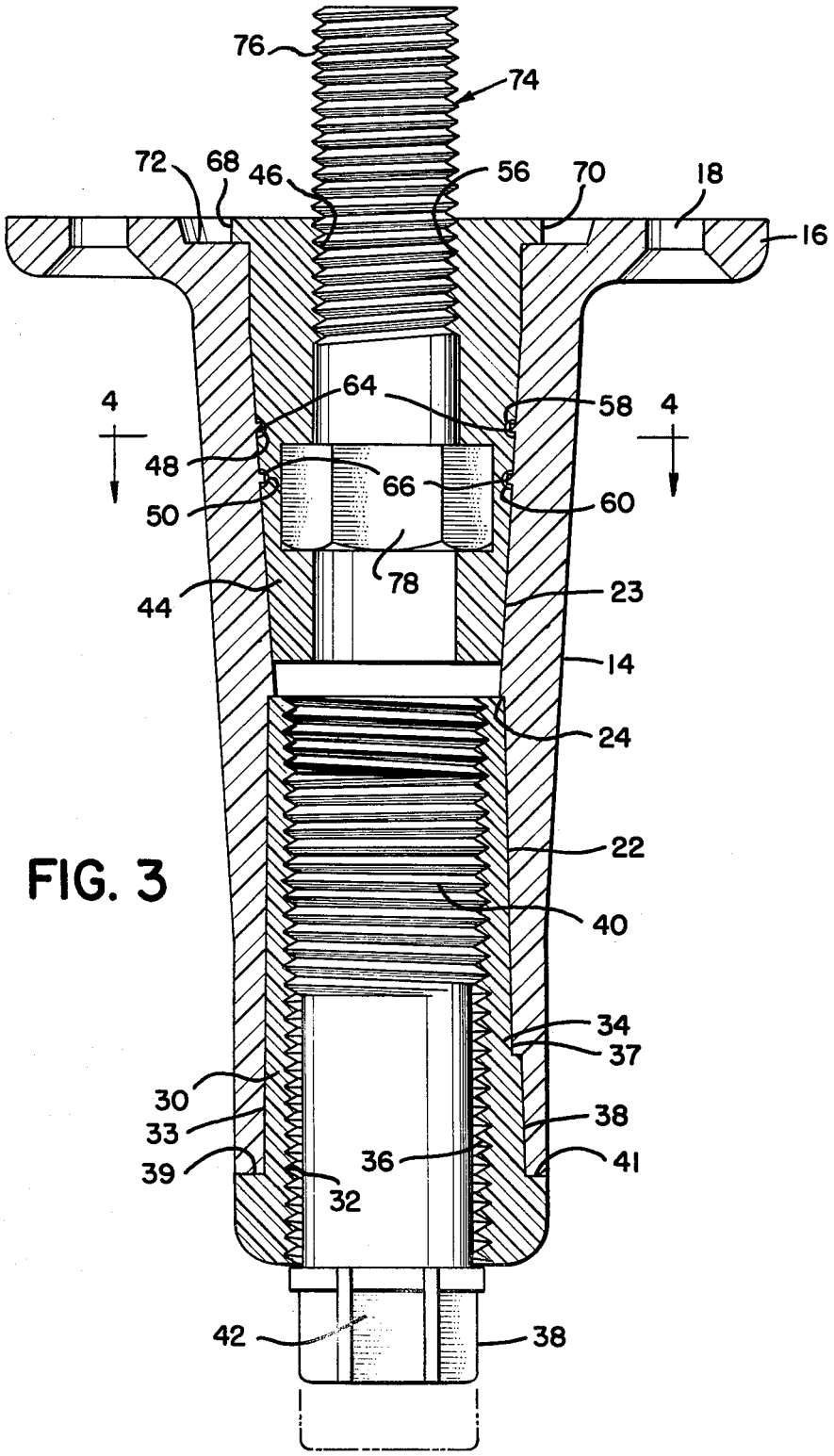
FIG. 3. is an enlarged, longitudinal, sectional view taken through the adjustable leg with the bolt adaptor assembly in place.

Although specific terms are used in the following description for the sake of clarity, these terms are intended to refer only to the particular structure of the invention selected for illustration in the drawings and are not intended to define or limit the scope of the invention.

Referring now to the drawings, there is shown in FIG. 1 a universal equipment leg 10 in use in supporting a piece 12 of commercial kitchen equipment, such as a refrigerator, range, oven, fryer or the like.

As illustrated in FIGS. 2 and 3, in the basic embodiment, the adjustable leg 10 comprises a body 14 which is preferably molded of a strong, moisture and vermin resistant plastic, or which may be formed of other materials, such as metal, of suitable strength for the use. As shown, the body terminates upwardly in an integral flange 16 which extends radially outwardly in known manner to provide an enlarged, stable mounting surface for affixing the leg 10 to the under surface of the equipment 12 to be supported thereby. A plurality of openings 18 are drilled, molded or otherwise provided in spaced locations about the flange 16 of suitable size to receive conventional fasteners (not shown) to secure the leg 10 to the piece of equipment 12. Depending upon the type of construction of the equipment itself, the fasteners could be wood screws, metal screws, bolts or other fasteners as may be necessary or desirable to secure the parts together.

Still referring to FIGS. 2 and 3, the body 14 of the leg is formed with an axial bore 20 that is medially divided by a shoulder 24 into an upper section 23 and a lower section 24. It will be noted that in this arrangement, the upper section 23 is not utilized for leg mounting purposes, but rather, the flange 16 is employed to secure the leg 10 to the piece of equipment. The lower section 22 is hollow, truncated, conical in configuration with a gentle flare or outward taper downwardly to receive and lock therein the adjustable foot assembly means.

As illustrated, the adjustable foot assembly means comprises a cooperating pair of split foot inserts 30, 34, each of which is molded, machined or otherwise formed to provide a respective threaded interior periphery 32, 36. The exterior peripheries 33, 37 of the split foot inserts 30, 34 are tapered to conform to the taper of the bottom section 22 of the body axial bore 20 and are sized to be tight press fit therein. One of the split foot inserts includes a radially projecting, elongated key 26 which is a sliding fit into the elongated groove or cooperating slot 28 which is formed near the bottom of the lower bore section 22. In the preferred embodiment, the split foot inserts 30, 34 terminate downwardly in respective shoulders 39, 41, which shoulders limit the upward movement of the split foot inserts 30, 34 within the bottom section of the axial bore 20 and also form a smooth continuation of the outer periphery of the body 14 to provide an aesthetically pleasing appearance. As shown in FIG. 3, the shoulders 39, 41 abut the bottom of the body 14 to form a seal therewith and the respective tops of the inserts 30, 34 abut medial shoulder 24 to form another seal therewith.

When the split insert halves 30, 34 are fully seated within the bore bottom section 22, the threaded interiors 32, 36 abut to provide a continuously threaded socket of suitable size and pitch to threadedly receive therein the adjustment foot 38. As shown, the adjustment foot comprises an upper threaded section 40 and a lower adjustment end 42. The threaded section 40 threadedly engages the threaded interiors 32, 36 to axially move the foot 38 upwardly and downwardly relative to the body 14 when the foot 38 is rotated. The lower adjustment end 42 is formed with a plurality of interconnected straight sides, which may be in the form of a hexagonal configuration, to facilitate foot rotation with a tool (not shown), for example a wrench. The key 26 and cooperating slot 28 discourage any tendency of the split foot inserts 30, 34 to rotate within the axial bore 20 when the axial position of the foot 38 is adjusted by rotating the foot.

With the parts in place and utilized as illustrated in FIG. 2, the universal leg 10 can be secured to the bottom of a piece of equipment 10 by employing suitable conventional fasteners through the flange bolt openings 18 in known manner to secure the parts together. When it is necessary or desirable to threadedly engage the universal leg 10 into a threaded socket (not shown) provided in the bottom of the piece of equipment 12 by the manufacturer in a known manner, then the threaded stud arrangement illustrated in FIGS. 3 and 5 can be utilized.

Figure 5:
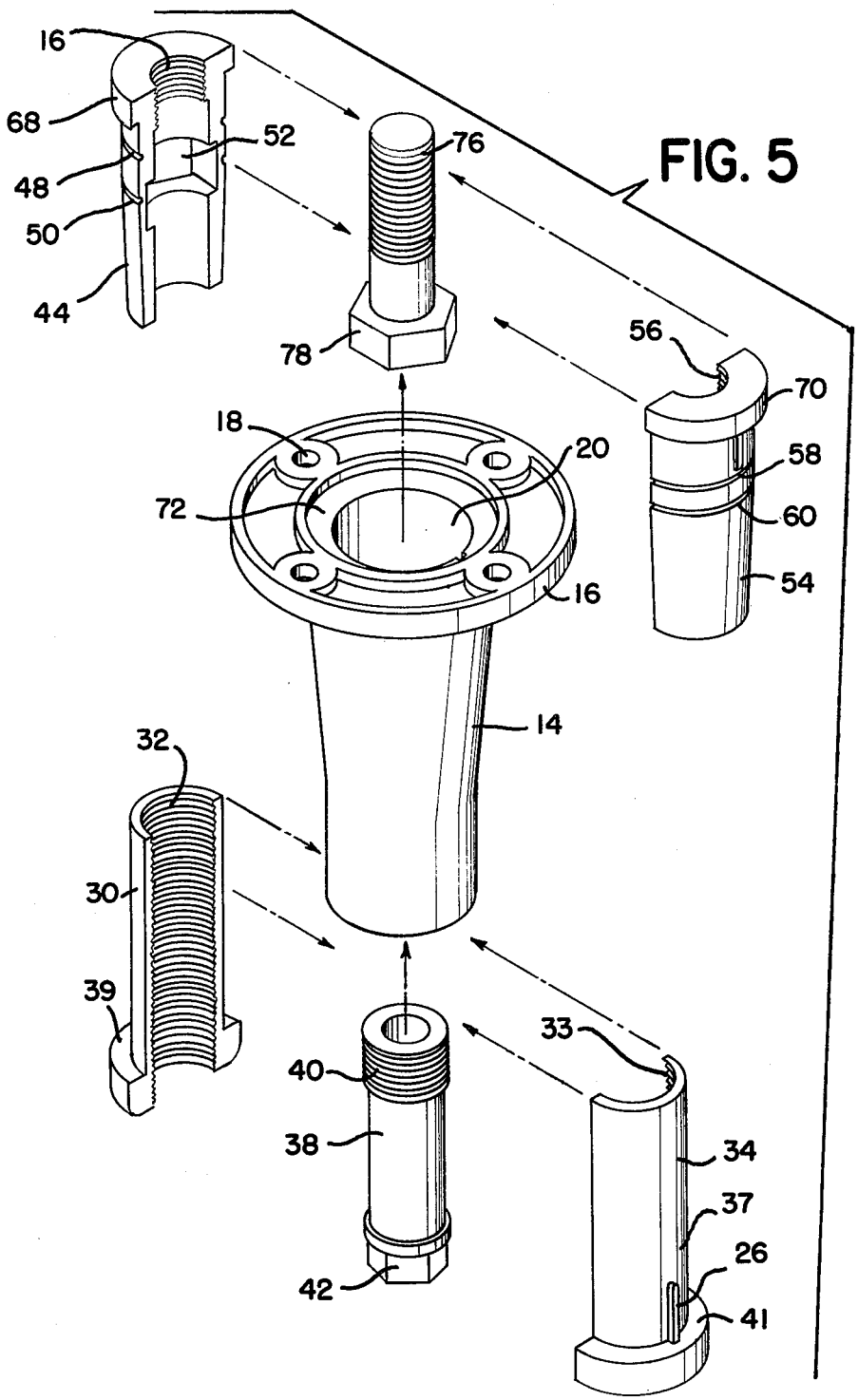
FIG. 5 is an enlarged, exploded, perspective view of the adjustable leg, showing the bolt adaptor assembly and the foot adaptor assembly.

In the embodiment shown in FIGS. 3 and 5, the upper section 23 of the axial bore 20 is employed to receive and lock therein a split stud adaptor assembly means whereby the threaded shank 76 of a bolt or stud 74 can be rigidly secured in position projecting axially upwardly from the top of the integral flange 16.

The split stud adaptor assembly means comprises first and second cooperating split bolt adaptor halves 44, 54, each of which includes an upper, interiorly threaded section 46, 56. When the split halves 44, 54 are joined and seated within the upper section 23 of the axial bore 20, the threaded sections 46, 56 form a continuous thread to receive and tightly hold therein a portion of the threaded shank 76 of the bolt or stud 74. Spaced downwardly from the threaded sections 46, 56 are respective, split, bolt head recesses 52, 62 of suitable size and shape to receive and lock therein the head 78 of the bolt 74. Thus, when the split bolt adaptor halves 44, 54 are secured within the upper bore section 23, the mounting bolt or stud 74 is rigidly secured in position.

It is an essential part of this invention to provide a single body design 14 to cooperate with and to receive therein any one of a plurality of various sized split stud adaptor assembly means. For example, the bolt or stud 74 could be ½", ⅝", etc. in diameter, 1½", 2", 2½", etc. in length with 10, 12, 13 or other pitch, which dimensions and pitch can be chosen as necessary to allow the stud 74 to threadedly engage essentially any threaded socket configuration (not shown) which may be employed by the manufacturer of the equipment 12. By providing split bolt adaptor halves 44, 54 with exterior dimensions and configurations suitable to lock within the bore upper section 23 and with threads 46, 56 and bolt head recesses 52, 62 of suitable dimensions and configurations to securely hold a particular bolt 74 therebetween, the leg 10 can be made universally adaptable to support almost all known variations of kitchen equipment.

Still referring to FIGS. 3 and 5, the axial bore upper section is provided with a pair of longitudinally spaced sealing rings 64, 66 which act the seal against the split bolt adaptor halves 44, 54 to prevent the entrance of moisture, contamination, vermin or the like into the axial bore 20. The split halves 44, 54 are respectively provided with cooperating peripheral grooves 48, 50 and 58, 60, which grooves respectively receive and lock upon the sealing rings 64, 66. It will be appreciated that the sealing rings 64, 66 must be sufficiently resilient to permit the lower exterior peripheries of the split adaptor halves 44, 54 to slide thereover when the adaptor halves are inserted downwardly into the upper bore section 23. Once the adaptor halves are fully inserted into the upper bore section 23, the sealing rings 64, 66 will snap into the peripheral grooves 48, 50 and 58, 60 to thereby provide an extremely tight, exceedingly strong construction.

Each of the split stud adaptor halves 44, 54 terminates upwardly in a respective top flange 68, 70. As best seen in FIG. 5, the axial bore 20 terminates upwardly in circular recess 72. The recess 72 is of the necessary size and configuration to receive therein the top flanges 68, 70 whereby the parts are so designed and arranged, that when the split stud adaptor halves 44, 54 are fully seated and locked within the upper bore section 23, the top surfaces of the flanges 68, 70 and the top surface of the integral flange 16 align in planar alignment to provide a planar mounting surface to receive thereon a portion of the equipment bottom for support purposes when the leg 10 is secured to the equipment 12 for adjustable support purposes. In a preferred embodiment one of the adaptor halves 44 or 54 is provided with a longitudinally extending key 80 and the upper bore section 23 is formed with a cooperating, longitudinally extending slot 82 (FIG. 4) to prevent the split halves 44, 54, and consequently the bolt or stud 74, from turning relative to the body 14 when the leg 10 is threadedly engaged with the equipment 12.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. In an adjustable equipment leg, the combination of
a hollow, elongated body defining an axial bore,
the bore including an upper section and lower section,
the body terminating upwardly in a widened flange;
a foot adaptor assembly insertable into the body at the lower bore section thereof,
the foot adaptor assembly comprising a foot and means to axially move the foot relative to the body to vary the height of the leg; and
a replaceable bolt adaptor assembly removably insertable into the body at the upper bore section thereof,
the bolt adaptor assembly comprising a threaded stud and split adaptor means to immovably secure the stud relative to the body, the split adaptor means comprising a pair of split halves, each half having a substantially smooth outer periphery and a threaded inner periphery, the outer periphery being adapted to slide into and seat within the said upper bore section, the threaded inner peripheries being adapted to receive and tightly hold the threaded portion of the stud to form a threaded extension for threadedly connecting the leg to a piece of equipment for equipment support.

2. The equipment leg of claim 1 wherein the size and pitch of the interior periphery conforms to the size and pitch of the stud threads and wherein the split halves form a continuous thread upon which the stud is threadedly engaged.

3. The equipment leg of claim 1 wherein the stud comprises a head and recess means shaped to conform to the configuration of the head to prevent axial movement of the stud relative to the body.

4. In an adjustable equipment leg, the combination of a hollow, elongated body defining an axial bore,
the bore including an upper section and a lower section,
the body terminating upwardly in a widened flange;
a foot adaptor assembly insertable into the body at the lower bore section thereof,
the foot adaptor assembly comprising a foot and means to axially move the foot relative to the body to vary the height of the leg;
a bolt adaptor assembly removably insertable into the body at the upper bore section thereof;
the bolt adaptor assembly comprising a threaded stud and adaptor means to immovably secure the stud relative to the body to form a threaded extension for threadedly connecting the leg to a piece of equipment for equipment support,
the adaptor means comprising a cooperating plurality of split bolt adaptor parts having outer peripheries conforming to the configuration of the upper bore section and being in tight engagement therewithin, whereby the bolt adaptor assembly is slidable into and engageable within the upper bore section to secure the stud,
the adaptor means further comprising recess means to prevent axial movement of the stud relative to the body; and
the said stud comprising an enlarged, configured head and the recess means being configured to receive the head, the configured recess means receiving at least a portion of the stud head therewithin to prevent rotative or axial movement of the stud relative to the body.

5. The equipment leg of claim 4 and a first seal between the upper bore section and the bolt adaptor assembly to prevent passage of contamination between the bolt adaptor assembly and the body.

6. The equipment leg of claim 5 wherein the first seal comprises a sealing ring formed in the upper bore section and projecting inwardly, the internal diameter of the sealing ring being less than the exterior diameter of the bolt adaptor assembly.

7. The equipment leg of claim 6 wherein the outer periphery of the bolt adaptor assembly is provided with a peripheral groove and wherein the sealing ring seats within the groove for sealing purposes.

8. The equipment leg of claim 5 and a second seal between the upper bore section and the bolt adaptor assembly, the second seal comprising a top circular recess formed in the body at the widened flange thereof and a top flange formed in the bolt adaptor assembly at the top thereof, the top flange of the bolt adaptor assembly being seated within the circular recess when the parts are assembled.

9. The equipment leg of claim 8 wherein the widened flange of the body and the top flange of the bolt adaptor assembly terminate upwardly in planar alignment.

10. The equipment leg of claim 8 and a third seal between the body and the foot adaptor assembly.

11. The equipment leg of claim 10 wherein the third seal comprises an internal shoulder formed in the body axial bore, the top surface of the foot adaptor assembly being in overall contact with the internal shoulder.

12. The equipment leg of claim 10 and a fourth seal between the body and the foot adaptor assembly.

13. The equipment leg of claim 12 wherein the fourth seal comprises a peripheral shoulder formed in the foot adaptor assembly, the peripheral shoulder being in overall contact with the bottom surface of the body.

* * * * *